US010192672B2

(12) United States Patent
Yang et al.

(10) Patent No.: US 10,192,672 B2
(45) Date of Patent: Jan. 29, 2019

(54) COIL COMPONENT AND METHOD OF MANUFACTURING THE SAME

(71) Applicant: SAMSUNG ELECTRO-MECHANICS CO., LTD., Suwon-si, Gyeonggi-do (KR)

(72) Inventors: Ju Hwan Yang, Suwon-si (KR); Jong Bong Lim, Suwon-si (KR); Seok Il Hong, Suwon-si (KR); Jae Yeol Choi, Suwon-si (KR); Hai Joon Lee, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 0 days.

(21) Appl. No.: 15/073,063

(22) Filed: Mar. 17, 2016

(65) Prior Publication Data

US 2017/0062121 A1 Mar. 2, 2017

(30) Foreign Application Priority Data

Aug. 24, 2015 (KR) ..... 10-2015-0119025

(51) Int. Cl.
*H01F 5/00* (2006.01)
*H01F 27/28* (2006.01)
*H01F 41/04* (2006.01)

(52) U.S. Cl.
CPC ..... *H01F 27/2804* (2013.01); *H01F 41/041* (2013.01)

(58) Field of Classification Search
CPC ..... H01F 27/2804; H01F 41/041; H01F 2017/0073; H01F 2027/2809
USPC ..... 336/200, 223, 233, 232
See application file for complete search history.

(56) References Cited

U.S. PATENT DOCUMENTS 5,396,212 A * 3/1995 Hernandez ..... H01F 27/2823 336/223
6,246,541 B1 * 6/2001 Furuichi ..... G11B 5/3116 360/123.41
6,333,830 B2 * 12/2001 Rose ..... G11B 5/82 360/123.41
6,452,742 B1 * 9/2002 Crue ..... G11B 5/313 360/123.31
2005/0184848 A1 8/2005 Yoshida et al.
2008/0003408 A1 * 1/2008 Masai ..... H01F 17/0033 428/161
2010/0025840 A1 * 2/2010 Dirks ..... H01F 41/041 257/690
2014/0292468 A1 * 10/2014 Motomiya ..... H01F 17/0013 336/200
2016/0163451 A1 * 6/2016 Wang ..... H01F 41/042 336/192

FOREIGN PATENT DOCUMENTS

JP 10-105920 A 4/1998
JP 2005-243807 A 9/2005

* cited by examiner

*Primary Examiner* — Mang Tin Bik Lian
(74) *Attorney, Agent, or Firm* — McDermott Will & Emery LLP

(57) ABSTRACT

A coil component includes a substrate and a coil pattern disposed on the substrate. The coil pattern includes a vertical region having a side surface perpendicular with respect to the substrate and a tapered region connected to the vertical region and having a side surface inclined with respect to the substrate.

7 Claims, 5 Drawing Sheets

COIL COMPONENT AND METHOD OF MANUFACTURING THE SAME

CROSS-REFERENCE TO RELATED APPLICATION

This application claims the benefit of priority to Korean Patent Application No. 10-2015-0119025, filed on Aug. 24, 2015 with the Korean Intellectual Property Office, the entirety of which is incorporated herein by reference.

TECHNICAL FIELD

The present disclosure relates to a coil component and a method of manufacturing the same.

BACKGROUND

A coil component is an electronic component that may be used to remove noise from various electronic devices.

In recent years, as electronic products have become smaller, slimmer, and ever more multifunctional, a coil component which may be miniaturized and thinned while improving noise removal performance has been developed.

Increasing the volume occupied by the coil pattern enhances characteristics of the coil component such as inductance and direct current resistance.

Generally, the coil pattern is formed by a photoresist technique. In the case of forming a photoresist pattern, there is a limit to reducing a width of the photoresist pattern or an interval between adjacent photoresist patterns due to inherent limitations of the technique.

The coil pattern may be formed by forming a seed layer on a substrate, forming a conductive pattern using plating, and then etching the conductive pattern. In this case, to form the conductive pattern and then remove the seed layer, a wet etching method has been used. A change in a coil shape and a loss of electrical characteristics of the coil may occur during the etching process.

In detail, a cross section of the coil pattern after wet etching may be decreased in size by at least 1 μm in a width direction, as compared to that of the conductive pattern before wet etching. When the coil pattern is reduced in width, there is a limit to forming the coil pattern to have a micro line width equal to or less than 10 μm.

Therefore, it is important to use a manufacturing method capable of reducing changes in the coil shape and the loss of electrical characteristics of the coil, while forming the coil pattern to have a micro line width, and it is very important to obtain a coil component having low electrical resistance by securing the size of the coil pattern.

Meanwhile, a coil component having a plurality of coil patterns has increased loss in proportion to the reduction in the size of the coil pattern.

SUMMARY

An exemplary embodiment in the present disclosure may provide a coil component capable of implementing a micro coil pattern and having a low electrical resistance by securing a size of a coil pattern, thereby allowing for reductions in product size.

According to an exemplary embodiment in the present disclosure, a coil component may secure a size of a coil pattern while areas of an upper end surface and a lower end surface of the cross section of the coil pattern may be different, thereby reducing parasitic capacitance between the coil patterns while enhancing inductance and resistance characteristics.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
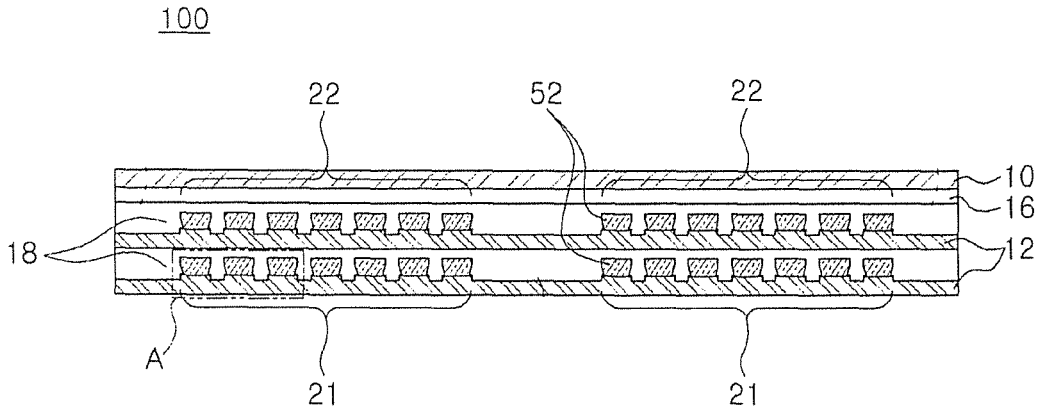
FIG. 1 is a cross-sectional view schematically illustrating a coil component according to an exemplary embodiment.

Hereinafter, embodiments of the present inventive concept will be described as follows with reference to the attached drawings.

The present inventive concept may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present inventive concept. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present inventive concept will be described with reference to schematic views illustrating embodiments of the present inventive concept. In the drawings, for example, due to manufacturing techniques and/or tolerances, modifications of the shape shown may be estimated. Thus, embodiments of the present inventive concept should not be construed as being limited to the particular shapes of regions shown herein, for example, to include a change in shape results in manufacturing. The following embodiments may also be constituted by one or a combination thereof.

The contents of the present inventive concept described below may have a variety of configurations and propose only a required configuration herein, but are not limited thereto.

Hereinafter, a coil component according to the present disclosure will be described.

Figure 2:
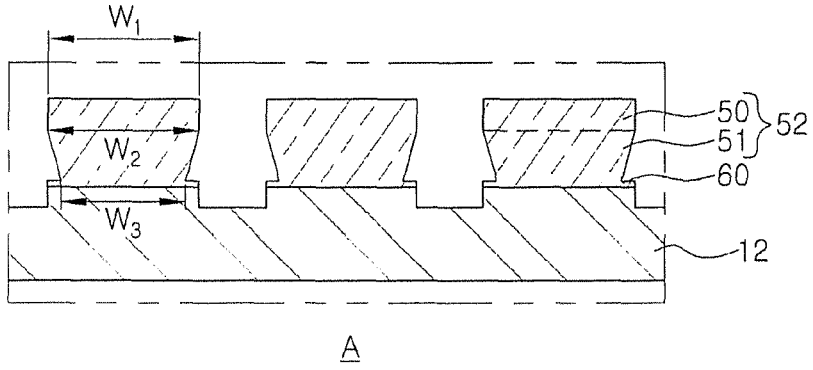
FIG. 2 is a diagram of a cross sectional shape of a coil pattern of the coil component according to the exemplary embodiment and is an enlarged view of portion A of FIG. 1.

FIG. 1 is a cross-sectional view schematically illustrating a coil component according to an exemplary embodiment and FIG. 2 is a diagram of a cross sectional shape of a coil pattern of the coil component according to the exemplary embodiment and is an enlarged view of portion A of FIG. 1.

Referring to FIGS. 1 and 2, a coil component 100 according to an exemplary embodiment may include coil patterns 52 on a substrate 12, in which the coil pattern 52 may include a vertical region 50 having a side surface perpendicular with respect to the substrate and a tapered region 51 connected to the vertical region 50 and having a side surface inclined with respect to the substrate.

The substrate 12 may be a magnetic substrate. An insulating layer 18 may be disposed on the substrate 12.

The substrate 12 may have protruding portions. The coil patterns 52 may be disposed on the protruding portions of the substrate 12. The protruding portions may be formed by an etching method in a process of manufacturing a coil pattern.

The substrate 12 formed of a magnetic material may include an iron (Fe) component. In this case, when an interval between coils is narrow, a conduction phenomenon may occur due to the iron component, or the like.

The coil component 100 may include an insulating layer (not illustrated) disposed between the substrate 12 and the coil pattern 21. The insulating layer may serve to insulate between the substrate 12 and the coil pattern 21.

In detail, in the coil component 100, an insulating layer 18 may be disposed on a substrate 10 including protruding portions, the coil patterns 21 and 22 may be formed in the insulating layer 18 and formed on the protruding portions of the substrate 12, and the coil patterns 21 and 22 may have a stacked structure. Further, the coil component 100 may include an adhesive layer 16 disposed on the stacked coil patterns 21 and 22 and the substrate 10 disposed on the adhesive layer 16.

The insulating layer 18 may be formed of polyimide or epoxy resin.

An upper portion of the substrate 12 may be provided with the coil patterns 21, 22, and 52 which may include at least one of gold, silver, platinum, copper, nickel, and palladium or alloys thereof.

The coil patterns 21, 22 and 52 may be formed of material which may impart conductivity but may not be limited to the above-mentioned metals.

The coil patterns 21, 22, and 52 may include the vertical region 50 having the side surface perpendicular to the substrate and the tapered region 51 connected to the vertical region 50 and having the side surface inclined to the substrate.

Referring to FIG. 2, the vertical region 50 may be disposed on the tapered region 51.

In this case, in a cross section of the tapered region 51, a width of an upper surface may be larger than that of a lower surface.

The coil pattern 52 may include the vertical region 50 having the side surface perpendicular with respect to the substrate and the tapered region 51 having the side surface inclined with respect to the substrate in a basic shape of a reversed trapezoid to considerably increase a cross sectional area of the coil pattern, thereby securing low electrical resistance.

The coil pattern 52 may include a seed region 60 disposed below the tapered region 51.

In the cross section of the coil pattern 52, a width of the seed region 60 may be equal to or larger than that of the vertical region 50 but the width of the seed region 60 is not limited thereto.

The seed region 60 may be a part of the seed layer upon the manufacturing of the coil patterns and may be formed of the same material as the vertical region 50 and the tapered region 51 and a boundary thereof may be integrated so as to be unable to be confirmed with the naked eye.

If the coil pattern 52 includes the seed region 60, the cross sectional area of the coil pattern may be increased, and as a result, the electrical resistance of the coil pattern may be reduced.

In the cross section of the coil pattern 52, a width W1 of the vertical region may be larger than a width W3 of the lower surface of the tapered region.

When the width W1 of the vertical region is wider than the width W3 of the lower surface of the tapered region, a positive type photoresist pattern may be used upon the manufacturing of the coil pattern. In this case, the width of the thin film area 51 may be wider than the width W3 of the lower surface of the tapered region.

The width of the vertical region may be the same (W1=W2) as a width of the upper surface of the tapered region.

Figure 5:
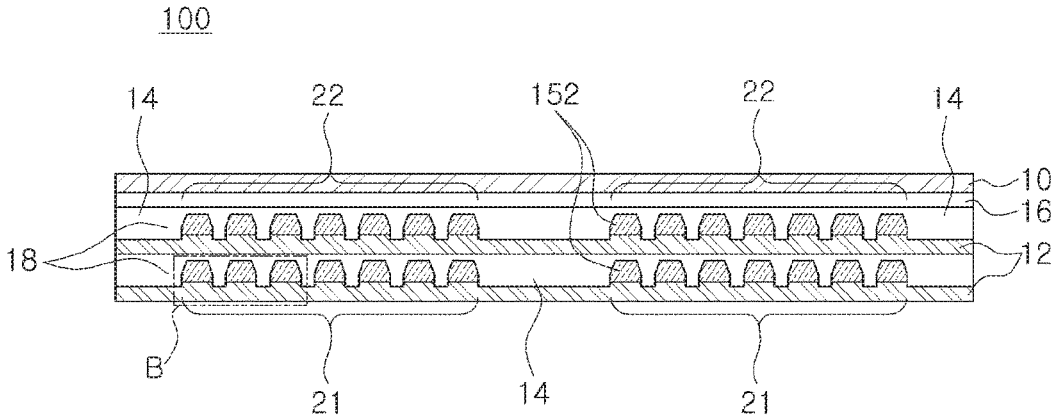
FIG. 5 is a cross-sectional view schematically illustrating a coil component according to another exemplary embodiment.
Figure 6:
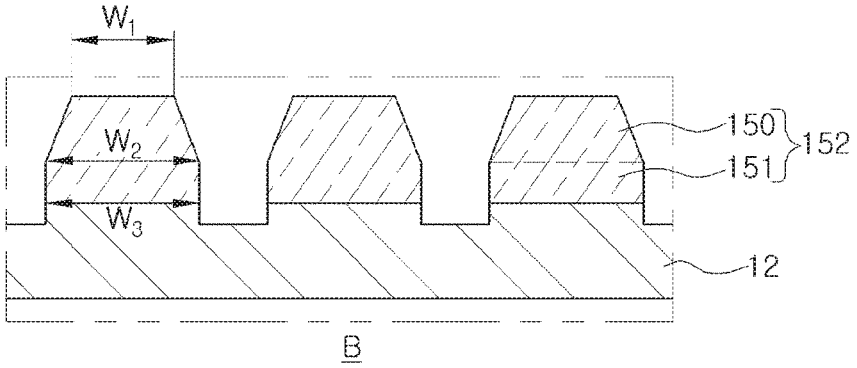
FIG. 6 is a diagram of a cross sectional shape of a coil pattern of the coil component according to another exemplary embodiment and is an enlarged view of portion B of FIG. 5.

FIG. 5 is a cross-sectional view schematically illustrating a coil component according to another exemplary embodiment and FIG. 6 is a diagram of a cross sectional shape of a coil pattern of the coil component according to another exemplary embodiment and is an enlarged view of portion B of FIG. 5.

The vertical region 150 may be disposed under the tapered region 151.

In this case, in a cross section of the tapered region 151, a width of an upper surface may be smaller than that of a lower surface.

The coil pattern 152 may include the vertical region 150 having the side surface perpendicular with respect to the substrate and the tapered region 151 having the side surface inclined with respect to the substrate in a basic shape of a trapezoid to considerably increase a cross sectional area of the coil pattern, thereby securing the low electrical resistance.

The coil pattern 152 may include a seed region (not illustrated) disposed below the vertical region 151.

In the cross section of the coil pattern, a width of the seed region may be equal to or larger than that of the vertical region, but the width of the seed region is not limited thereto.

The seed region may be a part of the seed layer upon the manufacturing of the coil patterns and may be formed of the same material as the vertical region and the tapered region and a boundary thereof may be integrated so as to be unable to be confirmed with the naked eye.

If the coil pattern 152 includes the seed region 60, the cross sectional area of the coil pattern may be increased, and as a result, the electrical resistance of the coil pattern may be reduced.

In the cross section of the coil area, the width W3 of the vertical region may be wider than the width W1 of the upper surface of the tapered region.

When the width W3 of the vertical region is wider than the width W1 of the upper surface of the tapered region, a negative type photoresist pattern may be used upon the manufacturing of the coil pattern. In this case, the width of the thin film area 51 may be wider than the width W3 of the lower surface of the vertical region.

The width of the vertical region may be the same (W1=W2) as a width of a lower surface of the tapered region.

Therefore, the cross sectional shape of the coil pattern 152 of the coil component in the present disclosure is that the width W1 of the tapered region is wider than the width W2 of the upper surface of the vertical region, and as a result, the parasitic capacitance occurring between the coil patterns may be decreased, thereby reducing electrical loss of the coil component.

The adjacent coil patterns need to maintain the least spaced distance to secure insulation. As the spaced distance between the coil patterns 52 and 152 is reduced, a volume of the coil pattern may be increased. Therefore, the interval between the coil patterns 52 and 152 may be 0.15 to 0.45 times of a width of a predetermined area and a cross sectional shape of the coil pattern may be formed within a range satisfying the range but the interval between the coil patterns 52 and 152 is not limited thereto.

Hereinafter, a method of manufacturing a coil component according to the present disclosure will be described.

Figure 3A:
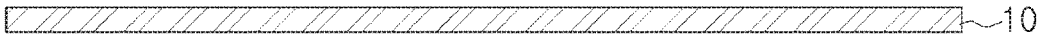
FIGS. 3A through 3F are schematic process cross-sectional views illustrating a method of manufacturing a coil component according to an exemplary embodiment.
Figure 3B:
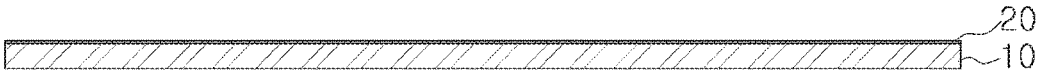
Figure 3C:
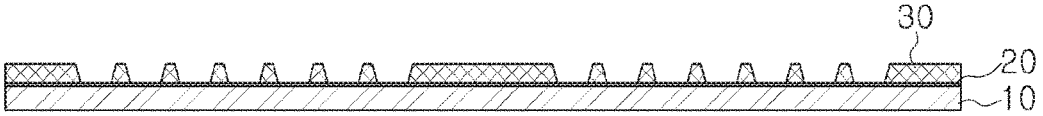
Figure 3D:
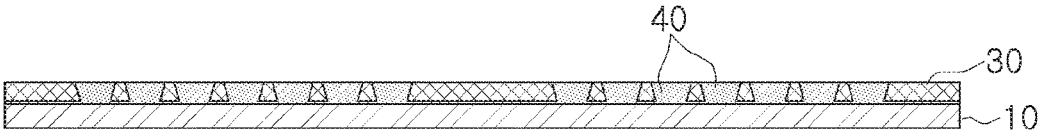
Figure 3E:
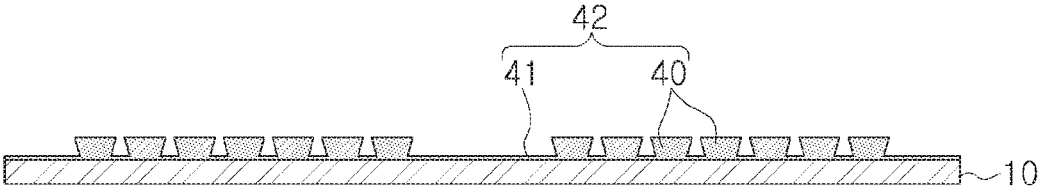
Figure 3F:
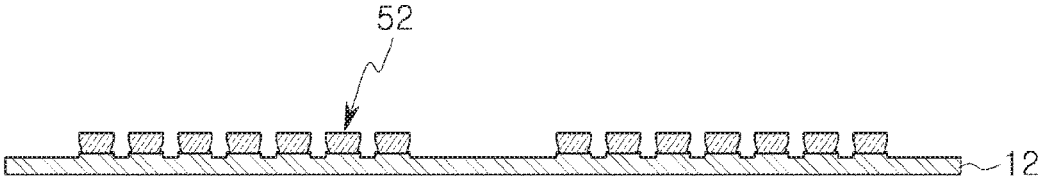
Figure 4:
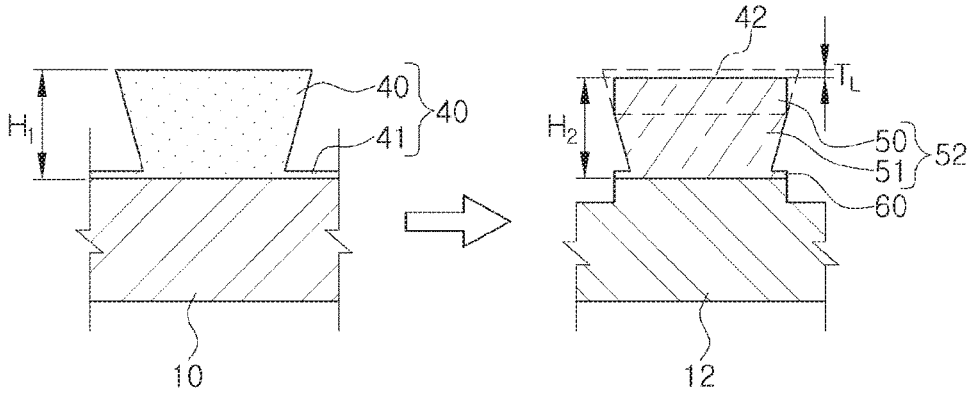
FIG. 4 is a diagram illustrating a change in shape of a coil pattern according to the method of manufacturing a coil component according to the exemplary embodiment.

FIGS. 3A through 3F are schematic process cross-sectional views illustrating a method of manufacturing a coil component according to an exemplary embodiment and FIG. 4 is a diagram illustrating a change in shape of a coil pattern according to the method of manufacturing a coil component according to the exemplary embodiment.

As illustrated in FIGS. 3A through 3F, the method of manufacturing a coil component according to an exemplary embodiment may include forming a base pattern 42 formed of metal on the substrate and forming the coil pattern 52 by etching a base pattern 42, in which the coil pattern 52 may include the vertical region 50 having the side surface perpendicular with respect to the substrate and the tapered region 51 connected to the vertical region 50 and having the side surface inclined with respect to the substrate.

First, referring to FIGS. 3A and 3B, the metal seed layer 20 is formed on a surface of the substrate 10.

The substrate 10 may be a magnetic substrate and the metal seed layer 20 may be formed on the surface of the substrate 10 by injecting a seed material for performing a subsequent plating method thereon by sputtering, or the like.

Next, referring to FIG. 3C, a photoresist pattern 30 is formed on the metal seed layer 20.

The photoresist pattern 30 may be formed by methods such as photoresist coating, exposure, and development.

The photoresist pattern 30 may be formed as a positive type photoresist.

Using the positive type photoresist, an exposed (area irradiated with light) portion is removed and an upper portion is narrower than a lower portion in a thickness direction (a direction of light transmission).

As a result, if the coil pattern is formed by using the positive type photoresist, a conductive material having a reverse trapezoidal cross sectional shape may be obtained during the subsequent plating method.

The photoresist pattern may be formed by applying metal to the metal seed layer and then removing an area to be plated.

Next, referring to FIG. 3D, the conductive material 40 may be formed by plating the surface of the metal seed layer 20 exposed between the photoresist patterns 30 with metal.

The metal may include at least one of gold, silver, platinum, copper, nickel, and palladium or alloys thereof.

The plating may be performed by electroplating.

Next, referring to FIG. 3E, the base pattern 42 is formed by removing the photoresist pattern 30.

The base pattern 42 includes the conductive material 40 and the metal seed layer 41. The conductive material 40 of the base pattern may have a reverse trapezoidal shape.

Next, referring to FIG. 3F, a coil pattern 52 may be formed by etching the base pattern 42.

Typically, upon the manufacturing of the coil pattern, the conductive pattern may be formed by forming the seed layer on the substrate, forming the conductive pattern using plating, and then etching the conductive pattern. In this case, to form the conductive pattern and then remove the seed layer, the wet etching method has been used. The change in the coil shape and the loss of electrical characteristics of the coil may occur during the etching process.

The coil pattern 52 in the present disclosure may be formed by reactive ion etching (RIE) etching the base pattern 42 with a physical force or dry etch such as an ion beam milling method.

Dry etching may be performed in a direction perpendicular with respect to the substrate 10.

Dry etching may perform an etch using chemical reaction and physical impact and may be performed in a direction in which the coil pattern is formed on the substrate.

In this case, the substrate 10 may be partially etched, except for the area in which the coil pattern is formed. After the etch, the substrate 12 may have protrusions on which the coil patterns are disposed.

Since the plating method is excessively performed and thus the coil patterns may contact each other or the least spaced distance may not be secured, dry etching may be performed to separate between the coil patterns.

Due to dry etching, the least spaced distance between the coil patterns may be secured and the occurrence of electrical short circuits between the coil pattern may be prevented.

In the case of performing dry etching, the existing wet etching method may not be performed, thereby easily implementing the electrical characteristics while reducing a loss rate of the cross sectional area of the coil pattern. Further, dry etching may be undertaken by only performing the etching method and therefore may more reduce the number of required processes than in the case of wet etching used in the etch-cleaning-dry processes, thereby reducing manufacturing costs and time.

The coil pattern 52 may include the vertical region 50 having the side surface perpendicular with respect to the substrate 12 and the tapered region 51 connected to the vertical region 50 and having the side surface inclined with respect to the substrate. As a result, the cross sectional area of the coil pattern may be considerably increased, and as a result, low electrical resistance may be secured.

The coil pattern 52 may include the seed region 60 disposed at the lower portion of the tapered region 51.

If the coil pattern 52 includes the seed region 60, the cross sectional area of the coil pattern may be increased, and as a result, the electrical resistance of the coil pattern may be reduced.

The vertical region 50 and the tapered region 51 may be an area formed by etching a portion of the conductive material 40 and the seed region 60 may be an area formed by etching a portion of the seed layer 41.

Referring to FIG. 4, the vertical region 50 may be disposed on the tapered region 51. In the cross section of the tapered region 51, the width of the upper portion may be larger than that of the lower portion.

Due to dry etching performed in the vertical direction, a height H2 of the coil pattern may be lower than a height H1 of the base pattern.

The coil pattern 52 may have a height loss $T_L$ greater than that of the base pattern 42. This is due to the process condition of dry etching, but the loss of the coil pattern may be insignificant compared to wet etching.

Dry etching may allow the reverse trapezoidal conductive material 40 to cut reverse trapezoidal upper corners to change the coil shape to the coil pattern including the vertical region 50 having the side surface perpendicular with respect to the substrate and the tapered region 51 having the side surface inclined with respect to the substrate.

Further, the seed layer 41 may form the seed region 60 formed by removing an area other than areas corresponding to the vertical region and the tapered region 50 and 51 by dry etching. In this case, a portion of the substrate may be removed in a direction in which dry etching is performed, along with a portion of the seed layer 41, thereby forming the protruding portions of the substrate 12.

The width of the vertical region 50 may be the same as the width of the upper surface of the tapered region 51 or may be wider than the width of the lower surface of the tapered region 51. For the base pattern 42 having the reverse trapezoidal shape, this may be formed by etching the reverse trapezoidal upper corners in an etching direction perpendicular with respect to the substrate.

Therefore, the cross section of the coil pattern 52 may include the seed region at the reverse trapezoidal lower portion in the reverse trapezoidal basic shape by dry etching and the reverse trapezoidal upper corners may be cut to form the vertical region 50 a side cut portion having a predetermined width.

Figure 7A:
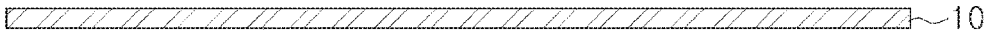
FIGS. 7A through 7F are a schematic process cross-sectional view illustrating a method of manufacturing a coil component according to another exemplary embodiment.
Figure 7B:
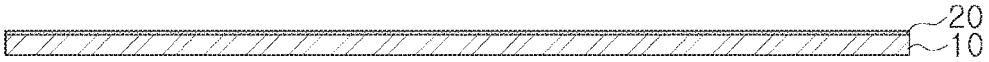
Figure 7C:
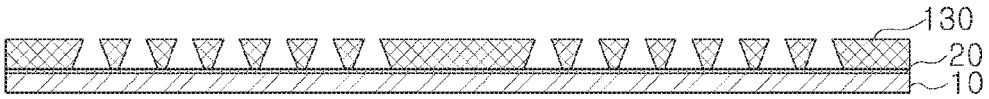
Figure 7D:
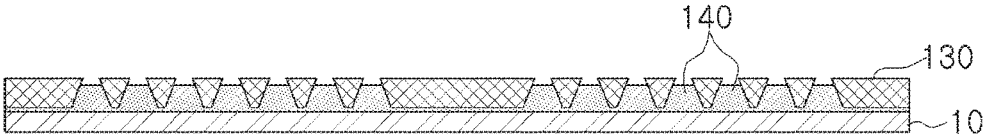
Figure 7E:
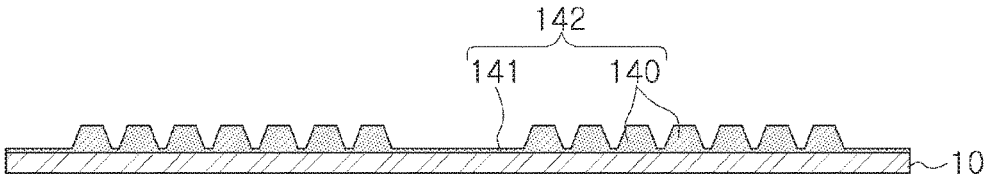
Figure 7F:
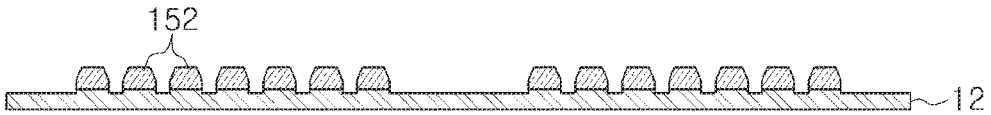
Figure 8:
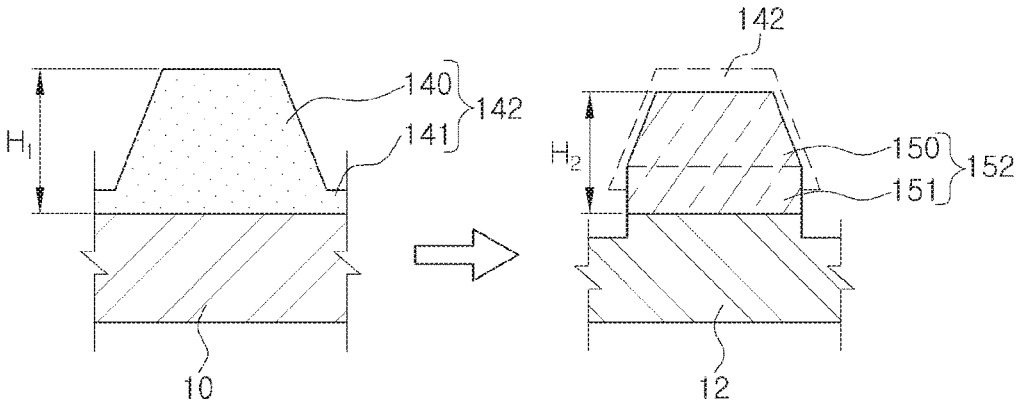
FIG. 8 is a diagram illustrating a change in shape of a coil pattern according to the method of manufacturing a coil component according to another exemplary embodiment.

FIGS. 7A through 7F are a schematic process cross-sectional view illustrating a method of manufacturing a coil component according to another exemplary embodiment and FIG. 8 is a diagram illustrating a change in shape of a coil pattern according to the method of manufacturing a coil component according to another exemplary embodiment.

Among components illustrated in FIGS. 7A through 7F and 8, the description of the same components as the components illustrated in FIGS. 3A through 3F and 4 will be omitted.

Referring to FIG. 7C, a photoresist pattern 130 is formed on the metal seed layer 20.

The photoresist pattern 130 may be formed as the negative type photoresist.

By the negative type photoresist, the area other than the exposed portion is removed and an upper portion is wider and a lower portion is narrower in a thickness direction of light transmission.

As a result, if the coil pattern is formed by using the negative type photoresist, a conductive material 140 having the trapezoidal cross sectional shape may be obtained during the subsequent plating method.

Next, referring to FIG. 7E, a base pattern 142 is formed by removing the photoresist pattern 130.

The base pattern 142 includes the conductive material 140 and a metal seed layer 141. The conductive material 140 of the base pattern may have a trapezoidal shape.

Next, referring to FIG. 7F, a coil pattern 152 may be formed by etching the base pattern 142.

The coil pattern 152 of the present disclosure may be formed by performing dry etching on the base pattern 142.

Referring to FIG. 8, the vertical region 150 may be disposed below the tapered region 151. In the cross section of the tapered region 151, a width of an upper portion may be smaller than that of the lower portion.

Due to dry etching performed in the direction perpendicular to the substrate, the height H2 of the coil pattern may be smaller than the height H1 of the base pattern.

Dry etching may allow the trapezoidal conductive material 140 to cut the trapezoidal upper corners to change the coil shape to the coil pattern 152 including the vertical region 150 having the side surface perpendicular with respect to the substrate and the tapered region 151 having the side surface inclined with respect to the substrate.

Further, the seed layer 141 may be removed by etching an area other than areas corresponding to the vertical region 150 and the tapered region 151 by dry etching to form a seed region (not illustrated). In this case, a portion of the substrate may be removed in a direction in which dry etching is performed, along with a portion of the seed layer.

The width of the vertical region 150 may be the same as a width of a lower surface of the tapered region 151 or may be larger than a width of a lower surface of the tapered region 151. For the base pattern 42 having the trapezoidal shape, this may be formed by etching the trapezoidal lower corners in an etching direction perpendicular with respect to the substrate.

Therefore, the cross section of the coil pattern 152 may include the seed region at the trapezoidal lower portion in the trapezoidal basic shape by dry etching and the trapezoidal lower corners may be cut to form the vertical region 150 a side cut portion having a predetermined width.

As a result, the cross sectional shape of the coil pattern 152 may be that the width of the upper surface is smaller than that of the lower surface, and therefore the parasitic capacitance occurring between the coil patterns may be reduced and the resistance characteristics may be enhanced. The electrical loss of the coil component may be reduced.

As set forth above, according to exemplary embodiments in the present disclosure, the coil component may have reduced parasitic capacitance and enhanced inductance and resistance characteristics.

While exemplary embodiments have been shown and described above, it will be apparent to those skilled in the art that modifications and variations could be made without departing from the spirit and scope of the present disclosure as defined by the appended claims.

What is claimed is:

1. A coil component, comprising:

a substrate; and a coil pattern disposed on the substrate, wherein the coil pattern includes a vertical region having a side surface perpendicular with respect to the substrate and a tapered region connected to the vertical region and having a side surface inclined with respect to the substrate, in a cross section of the coil pattern, a minimum width of the tapered region is less than a minimum width of upper and lower surfaces of the coil pattern, the vertical region and the tapered region form a trapezoidal shape and are made of the same material, and wherein a spacing between coil pattern turns is between 0.15 and 0.45 times a width of a cross sectional shape of the coil pattern.

2. The coil component of claim 1, wherein the vertical region is disposed on the tapered region.

3. The coil component of claim 2, wherein in a cross section of the tapered region, a width of an upper surface is larger than that of a lower surface.

4. The coil component of claim 1, wherein in a cross section of the tapered region, a width of an upper surface is smaller than that of a lower surface.

5. The coil component of claim 1, wherein the substrate has a protruding portion.

6. The coil component of claim 5, wherein the coil pattern is disposed on the protruding portion of the substrate.

7. The coil component of claim 1, wherein the coil pattern includes a seed region disposed at the vertical region or a lower portion of the tapered region.

* * * * *